US009393581B2

(12) United States Patent
Rasa et al.

(10) Patent No.: US 9,393,581 B2
(45) Date of Patent: Jul. 19, 2016

(54) METHOD FOR CONTROLLING THE TEMPERATURE OF A JETTING DEVICE

(71) Applicant: OCE-TECHNOLOGIES B.V., Venlo (NL)

(72) Inventors: Mircea V. Rasa, Eindhoven (NL); Marcel Slot, Baarlo (NL); Henricus C. M. Van Genuchten, Eindhoven (NL); Wilhelmus P. J. Classens, Castenray (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/087,950

(22) Filed: Nov. 22, 2013

(65) Prior Publication Data

US 2014/0076988 A1 Mar. 20, 2014

Related U.S. Application Data

(63) Continuation of application No. PCT/EP2012/060421, filed on Jun. 1, 2012.

(30) Foreign Application Priority Data

Jun. 7, 2011 (EP) ..... 11168998

(51) Int. Cl.
*B05B 7/22* (2006.01)
*B41J 2/045* (2006.01)
(Continued)

(52) U.S. Cl.
CPC ..... *B05B 7/22* (2013.01); *B05B 5/1608* (2013.01); *B05B 12/004* (2013.01); *B41J 2/04515* (2013.01); *B41J 2/04563* (2013.01); *B41J 2/04586* (2013.01); *B41J 2202/04* (2013.01)

(58) Field of Classification Search
CPC ..... B22D 41/50; B05B 5/00; B05B 5/1608; B05B 7/22; B05B 12/004; B41J 2/04515; B41J 2/04563; B41J 2/0458; B41J 2202/04; B41J 2/04586; H05K 2203/0126
USPC ..... 239/13, 135, 690, 79, 81–83, 128, 129, 239/132–133, 139; 118/300; 427/422; 222/590–594; 266/236, 237; 164/271; 347/5, 9, 14, 53–55
See application file for complete search history.

(56) References Cited

U.S. PATENT DOCUMENTS 3,682,458 A * 8/1972 Piwonka et al. ..... 373/151
4,919,335 A * 4/1990 Hobson et al. ..... 239/3
(Continued)

FOREIGN PATENT DOCUMENTS

EP 2213455 A1 8/2010
WO WO 96/09121 A1 3/1996
(Continued)

OTHER PUBLICATIONS

Elert, Glenn, "Melting Point of Glass", 2002, The Physics Factbook.*
(Continued)

*Primary Examiner* — Len Tran
*Assistant Examiner* — Cody Lieuwen
(74) *Attorney, Agent, or Firm* — Birch, Stewart, Kolasch & Birch, LLP

(57) ABSTRACT

A method for controlling a temperature of a jetting device, the jetting device being configured to jet droplets of a fluid at a high temperature, the fluid comprising an electrically conductive fluid, wherein at least a part of the fluid is positioned in a magnetic field, includes heating the jetting device to an operating temperature, being defined as the temperature suitable for jetting droplets, using a heat jetting droplets by providing an electrical actuation current in the part of the fluid positioned in the magnetic field, thereby generating a force in the conductive fluid; determining upcoming jetting conditions, the upcoming jetting conditions being defined as the jetting conditions corresponding to droplets to be jetted at a time ($t_1$) which is later than the present time ($t_0$); determining settings for the heat based on the determined upcoming jetting conditions; controlling the heating of the jetting device using the heat in accordance with the determined settings.

23 Claims, 2 Drawing Sheets

(51) Int. Cl.
*B05B 5/16* (2006.01)
*B05B 12/00* (2006.01)

(56) References Cited

U.S. PATENT DOCUMENTS 5,377,961 A * 1/1995 Smith et al. ..... 266/237
5,560,543 A * 10/1996 Smith et al. ..... 239/102.2
5,876,615 A * 3/1999 Predetechensky ..... 222/590
5,946,007 A 8/1999 Otsuka et al.
6,202,734 B1 * 3/2001 Sackinger et al. ..... 164/271
2006/0102663 A1 * 5/2006 McGeoch ..... 222/591

FOREIGN PATENT DOCUMENTS

WO WO 2010/063576 A1 6/2010
WO WO 2010063576 A1 * 6/2010 ..... B22F 9/08

OTHER PUBLICATIONS

Mussler, Bernhard H., "Aluminum Nitride", 2000, Anceram, <http://www.anceram.com/pdf/aln_artikel_bull.pdf>.*

* cited by examiner

METHOD FOR CONTROLLING THE TEMPERATURE OF A JETTING DEVICE

CROSS REFERENCE TO RELATED APPLICATIONS

This non-provisional application is a Continuation of International Application No. PCT/EP2012/060421 filed on Jun. 01, 2012, which claims the benefit of Europe Application No. 11168998.0 filed in Europe on Jun. 07, 2011. The entire contents of all of the above applications are hereby incorporated by reference.

The present invention relates to a method for controlling the temperature of a jetting device and a jetting device suitable for performing such a method. In particular the present invention relates to a method for controlling the temperature of a jetting device comprising an actuation means that produces a large amount of heat when operated which has a significant influence on the actual operating temperature of the jetting device. More in particular the present invention relates to a method for controlling the temperature of a jetting device which operates at elevated temperatures.

BACKGROUND OF THE INVENTION

WO 2010063576 discloses a device for jetting droplets of a fluid at a high temperature, wherein the fluid is actuated by generating a Lorentz force in the fluid, further referred to as Lorentz actuation. To be able to generate a Lorentz force the fluid must comprise an electrically-conductive fluid. The device is suited to eject droplets of fluid at a high temperature, in particular of a molten metal or a molten semi-conductor, more in particular of metals having a high melting temperature (e.g. higher than about 1200 K), such as gold, silver, copper, titanium and the like. A Lorentz force is generated in the fluid, by applying an electric current pulse through the fluid, the fluid being positioned in a magnetic field. A direction and magnitude of the resulting force is related to the cross product of the electric current and the magnetic field vector: $\vec{F} = \vec{I} \times \vec{B}$.

The Lorentz actuation method uses current pulses, which due to the Joule effect additionally heat the fluid and eventually the jetting device. The generated heat (Q [W]) is proportional to the square of the applied current (I [A]) and the total resistance (R [Ω]) of the parts of the print head through which the actuation current runs, comprising the electrode resistance, the print head material resistance, the liquid metal resistance, and contact resistances (e.g. contacts between electrodes and print head material, contact of electrodes with the liquid metal). The generated heat is further proportional to the duration of the current pulse (Δt [s]) and the pulse frequency (f [Hz]): $Q \sim I^2 * R * \Delta t * f$ (as derived from Joule's first law). For the purpose of jetting droplets according to the above described method, the applied current may be very high (i.e. in the order of 100 A-200 A). At very low frequency (e.g. ~1-10 Hz) and short pulse widths (e.g. <50 μs) the Joule effect is small.

However, the intended operating regime of the jetting device is at high frequencies (e.g. about 5 kHz or even higher). It is observed that at such high frequencies the average temperature of the jetting device, in particular of the nozzle can get extremely high and therefore lead to overheating of the jetting device. This situation is undesired because it affects the jetting process, because the properties of molten metals and semi-conductors are temperature dependent. Moreover, overheating may cause damage to the receiving substrate, because the temperature of the droplets reaching the substrate may become too high. Eventually, the jetting device may become damaged. For example because of softening or even melting of the materials making up the jetting device (such as the electrodes), in particular when materials having a high melting temperature (e.g. above 1000° C.) are jetted.

Therefore a need exists for a method for adequately controlling the temperature and preventing overheating of a jetting device for jetting droplets of a fluid at a high temperature, wherein the fluid is actuated by generating a Lorentz force in the fluid.

In addition there may be other situations requiring a method for adequately controlling the temperature of a jetting device for jetting droplets of a fluid at a high temperature, such as:

- situations wherein strongly heated substrates for printing are used. A strongly heated substrate (e.g. at 500° C.) may influence the temperature of the nozzle;
- situations wherein various actuation pulses are used in the jetting-printing process. Various actuation pulses may result in a fluctuation of the nozzle temperature;
- situations wherein all fluid present in a fluid chamber arranged in the jetting device to hold the fluid (also termed cartridge) has to be jetted. In such a situation the temperature of the nozzle may significantly decrease (e.g. with more than 100° C.), when the fluid level in the fluid chamber decreases, which may need to be compensated for by adequate temperature control;
- situations wherein instabilities of the heating source occur.

It is therefore an object of the present invention to provide such a method.

It is another object of the present invention to provide a jetting device suitable for performing such a method.

SUMMARY OF THE INVENTION

The objects are at least partly achieved by providing a method for controlling a temperature of a jetting device, the jetting device being configured to jet droplets of a fluid at a high temperature, the fluid comprising an electrically conductive fluid, wherein at least a part of the fluid is positioned in a magnetic field, the method comprising the steps of:

a. heating the jetting device to an operating temperature, being defined as the temperature suitable for jetting droplets, using a primary heating means;
b. jetting droplets by providing an electrical actuation current in the part of the fluid positioned in the magnetic field, thereby generating a force in the conductive fluid;
c. determining upcoming jetting conditions, the upcoming jetting conditions being defined as the jetting conditions corresponding to droplets to be jetted at a time ($t_1$) which is later than the present time ($t_0$);
d. determining settings for the primary heating means, based on the determined upcoming jetting conditions;
e. controlling the heating of the jetting device using the primary heating means in accordance with the determined settings.

In an embodiment, the order of the method steps may be as indicated above (i.e. a, b, c, d d e).

In an embodiment, the order of the method steps may be c, d, a, b and e. It is an advantage of this embodiment that the upcoming jetting conditions and the accompanying settings for the primary heating means may be determined for an entire print job (e.g. a line, an entire substrate, a pattern and the like) prior to starting the jetting process (step b). The controller may then determine beforehand if the entire print job can be performed within the requirements of the jetting process (e.g. jetting frequency during the entire print job) without overheating the jetting device.

Before starting jetting droplets, a desired pattern of dots to be printed on a receiving substrate is known and therefore the number of droplets to be jetted as a function of time and the corresponding jetting conditions (e.g. actuation frequency) are known (i.e. time dependent load).

In the method for controlling a temperature of a jetting device according to the present invention, further referred to as feed-forward temperature control method, the heating provided by the primary heating means may be controlled in real-time (at $t=t_0$) based on the knowledge of the contribution of future actuations (at $t=t_1$) to the heating of the fluid and hence the jetting device. Therefore the temperature of the jetting device may be maintained between certain limits and overheating may be prevented.

Using a relation between the jetting conditions, the settings of the primary heating means and the temperature of the jetting device, optimal settings for the primary heating means may be determined once the time dependent load and the corresponding time dependent jetting conditions at the desired operating temperature of the jetting device are known. Said relation may be implemented in a controller in any form, for example in the form of a database of actual temperature measurements as a function of jetting conditions and operating temperature (e.g. a look-up table), in the form of an algorithm based on theoretical calculations, a combination of both or any other form. Newly obtained data during operation of the jetting device may be incorporated in the above described database, such that a self-learning control method may be obtained.

In practice the settings of the primary heater may be adjusted immediately after starting the jetting process to compensate for the Joule heating, generated by the initially jetted droplets, based on the initial jetting conditions.

For the purpose of the present invention a jetting process may be defined as a process for generating droplets of a fluid by a jetting device. The jetting process may be characterized by jetting parameters, which may comprise the jetting temperature, the jetting (actuation) frequency, actuation current pulse shape and width. The jetting parameters may be selected such that the jetted droplets may have a certain size ($d_p$), a certain exit velocity ($v_p$), a certain exit temperature and no or minimized satellite formation (i.e. one or more small sized droplets following a main droplet which may be formed by breaking up of the main droplet in the drop formation process).

A printing process may be defined as a process for creating a printed pattern (e.g. a pattern comprising parallel straight lines or a circuit) on a receiving substrate. The printing process may be characterized by printing parameters which may comprise the printing speed (i.e. productivity), the required number of dots per unit of length (or dot pitch, which represents the distance between two adjacent dots) and the impact temperature on the substrate, which may be correlated to the exit temperature of a droplet.

For a given print job, the jetting parameters may be correlated to the printing parameters.

The jetting and printing parameters are also referred to as the jetting and printing conditions.

In an embodiment, steps c, d and e are repeatedly performed during operation of the jetting device.

Steps c-e of the present embodiment may be repeatedly performed either at discrete time intervals during operation of the jetting device or continuously. The method according to this embodiment wherein the heating of the jetting device based on changing jetting conditions may be adjusted at discrete time intervals during operation of the jetting device or continuously enables an even better control of the temperature of the jetting device.

In an embodiment the method according to the present invention comprises the additional steps of:

f. measuring the actual temperature of the jetting device during operation of the jetting device;

g. determining settings for the primary heating means, based on the actual temperature of the jetting device;

h. heating the jetting device using the primary heating means, based on the determined settings for the primary heating means.

The additional steps f-h of the present embodiment may be performed either at discrete time intervals during operation of the jetting device or continuously. The method according to this embodiment wherein the heating of the jetting device based on changing jetting conditions may be adjusted at discrete time intervals during operation of the jetting device or continuously. The measurement of the actual temperature may be used to fine-tune the settings for the primary heating means, which enables a further improved control of the temperature of the jetting device. The fine tuning may be performed by relatively small adaptation of the settings for the primary heating means as obtained from a data-base or by retrieving new settings from said database.

Measurements of the actual temperature of the jetting device may be used in a feed-back control loop as a secondary control mechanism to adjust or tune the heating using the primary heating means. Measurements of the actual temperature of the jetting device may also be recorded and added to the database together with the corresponding settings of the primary heating means and jetting conditions. Measurements of the actual temperature in a high temperature environment are preferably performed with a pyrometer, which is a non-contacting device that measures thermal radiation.

In an embodiment, a first temperature of the jetting device may be controlled by controlling a second temperature of the jetting device. The first temperature ($T_1$) for example being a temperature of the fluid in a region where actuation currents are passed through the electrically conductive fluid. The local temperature of the electrically conductive fluid in the actuation region of the jetting device may increase due to the Joule effect of the actuation currents being passed through the electrically conductive fluid.

The second temperature ($T_2$) may be a bulk temperature of the electrically conductive fluid which may be directly influenced by the primary heating means. Preferably a calibration between the first and the second temperatures is performed and is used to control the first temperature by controlling the second temperature.

The first temperature preferably being maintained within a specified range being defined as: $T_{1,min} \leq T_1 \leq T_{1,max}$ The second temperature preferably being maintained within a specified range being defined as: $T_{2,min} \leq T_2 \leq T_{2,max}$ Wherein $T_{1,min}$ and $T_{2,min}$ may represent the minimum temperatures of the fluid in the actuation region and of the bulk fluid respectively. Both minimum temperatures must at least be higher than the melting temperature of the electrically conductive fluid in order to prevent solidification of the fluid during jetting. Preferably the minimum temperatures, in particular $T_{2,min}$, are selected such that the viscosity of the electrically conductive fluid is low enough to be able to be jetted upon Lorentz actuation of the fluid. Generally, the viscosity of molten metals is low enough to be able to jet droplets, however, when the material to be jetted is a non-eutectic (metal) alloy, there may exist a more gradual solid-liquid transition, i.e. a melting trajectory. The melting trajectory being defined as a temperature window having a lower temperature limit and an upper temperature limit, between which limits the non-eutectic (metal) alloy undergoes the gradual solid-liquid transition. For such materials the minimum temperatures as explained above are preferably above the upper temperature limit of the melting trajectory.

$T_{1,max}$ and $T_{2,max}$ may represent the maximum temperatures of the fluid in the actuation region and of the bulk fluid respectively. The maximum temperatures may generally be selected such that a certain stability and accuracy in the jetting process are maintained. The maximum temperatures are ultimately determined by the materials used for the jetting device. In order to prevent softening or even melting of such materials, both maximum temperatures are preferably selected below a temperature at which said softening occurs.

In practice, the temperature of the fluid in the actuation region ($T_1$) is most important to monitor and to control, because $T_1$ has a marked influence on the jetting process (i.e. the quality of the droplet formation: droplet diameter, droplet velocity, satellite formation and the like) and on the printing process (i.e. dot-spreading on the substrate, heat resistance of the substrate, and the like).

For jetting at high loads (i.e. high jetting frequencies) for longer periods of time (thus generating a lot of heat due to the Joule effect of the Lorentz actuation), the temperature in the fluid actuation region ($T_1$) may increase to such an extent, that the required bulk temperature ($T_2$) for adequately cooling the actuation region by bulk fluid may become too low to maintain a proper operation of the jetting device (e.g. the bulk temperature may approach the melting point of the liquid material to be jetted, potentially leading to solidification of the bulk of the liquid material). By reducing the actuation frequency, less heat is generated in the actuation region and the bulk temperature, $T_2$, may be kept in a safe operating range without overheating the jetting device. A longer and safer operation of the jetting device may be obtained.

Therefore, in an embodiment, the method according to the present invention comprises the following additional steps:

determining the second temperature ($T_2$);

reducing the actuation frequency if $T_2 \leq T_{2,min}$.

These additional steps prevent overheating of the jetting device in cases where the jetting device operates at high loads (i.e. high jetting frequencies) for longer periods, as discussed above.

As a consequence, the jetting process (e.g. droplet formation) and the printing process (e.g. productivity) may change due to a reduction of the jetting frequency. This embodiment is of particular use when metals having a very high melting point are to be jetted with a high productivity. The operating temperature in such embodiments may be relatively close to the melting points of the materials making up the jetting device (such as the electrodes), the walls of the fluid chamber and optionally the coatings applied to these walls. The maximum temperature $T_{1,max}$ as discussed above may then be reached, in particular at high actuation frequencies. In such cases the actuation frequency may be adjusted during a printing process in order to prevent overheating of the jetting device.

In an embodiment, the difference between $t_1$ and $t_0$ may be equal to a thermal response time ($\Delta t_R$) of the jetting device and/or the electrically conductive fluid contained inside the jetting device.

The thermal response time may be dependent on the ability of the jetting device including the electrically conductive fluid to transport heat and therewith level the temperatures. The thermal response time may be dependent on heat transport phenomena such as:

forced convective heat transfer : due to mass transport from the bulk to the actuation region, heat present in the bulk of the electrically conductive fluid may be transported from the bulk to the actuation region. For example, if $T_2<T_1$ this mass transport may have a cooling effect on the actuation region. If $T_2>T_1$ the fluid in the actuation region may be heated by bulk fluid.

free convective heat transfer: differences in temperatures within the molten electrically conductive fluid may cause free convective flow of the fluid from regions having a higher temperature, to regions having a lower temperature. Free convective heat transfer may occur even when no droplets are jetted.

heat conduction: the heat conductive properties of the materials making up the jetting device and of the electrically conductive fluid may determine the ability of the jetting device to conduct heat in order to level the temperatures.

heat radiation : the jetting device may loose heat due to heat radiation, in particular when the jetting device acts as a 'black body'. To prevent excessive heat losses through radiation, the jetting device may be at least partly surrounded by a reflecting surface, for example an aluminum housing with polished inner walls (the inner walls facing the outer walls of the jetting device).

In practice, the above described phenomena may occur in combination with each other and a thermal equilibrium situation may be established dependent on the operating conditions of the jetting device (e.g. primary heater settings and jetting conditions). To reach said equilibrium a certain amount of time ($\Delta t_{R,1}$) is required. When the operating conditions change, a new equilibrium may be reached within a different amount of time ($\Delta t_{R,2}$).

The thermal response time ($\Delta t_R$) of the jetting device and/or the electrically conductive fluid contained inside the jetting device may be empirically determined, for example by measuring actual temperature changes upon changing operating conditions.

In an embodiment, the settings for the heating means comprise a parameter for controlling the heating power of the primary heating means, being current and/or voltage. The heating power may also be adjusted by using pulse width modulation of the driver signal of the primary heating device.

In an embodiment, the heating means may be an inductive heating generator and the settings for the heating means comprise a heating current. The inductive heating generator comprises an induction coil which is arranged such that when operated (i.e. passing a high frequency alternating current (AC) through the induction coil) eddy currents are generated in electrically conductive materials. These eddy currents generate heat (Joule heating). For the purpose of the present invention, a part of the jetting device comprising the material to be jetted (i.e. the fluid chamber) may be made of an electrically conductive material (for example graphite), such that the fluid chamber is heated by inductive heating and the material to be jetted (e.g. a metal or semi-conductor) is melted and heated by heat conduction. The material to be jetted itself may also be heated by inductive heating.

An advantage of using inductive heating is that the heating instantaneously stops when the power to the induction coil is interrupted. On the other hand, the heating instantaneously starts when the power to the induction coil is re-established. Due to these quick responses, inductive heating may be suitably performed with a pulse-width modulation (PWM) technique.

In an embodiment, the heating is adjusted by at least partly shielding the inductive heating generator by using an electrically conductive shielding means. Such a shielding means may be a hollow body having an electrically conductive wall (e.g. a cylinder 100 as shown in FIG. 1) which can be moved between the induction coil and the jetting device (in particular the fluid chamber of the jetting device). The electrically conductive shielding means may take over at least a part of the induction currents that would otherwise be generated in the electrically conductive material of the fluid chamber and/or the electrically conductive fluid itself. The shielding means is therefore inductively heated, while other parts of the jetting device including the electrically conductive fluid are enabled to cool down, or at least heated to a lesser extent. The shielding means may for example be made of graphite and may optionally be cooled.

In an embodiment, the electrically conductive fluid to be jetted comprises a molten metal or a molten semi-conductor.

In an embodiment, the electrically conductive fluid comprises an electrically non-conductive fluid and an electrically conductive medium. The electrically conductive medium may be a molten metal, which can be actuated using Lorentz actuation. The electrically conductive medium preferably has a melting point below the melting point of the electrically non-conductive fluid and below the jetting temperature. The boiling point of the metal is preferably above the jetting temperature of the electrically non-conductive fluid. The higher the electrical conductivity of the metal, the more efficient a Lorentz force can be generated in the metal.

When the metal is molten, the metal mass may be easily deformed by applying a Lorentz force onto the molten metal. This deformation may apply a force onto another object adjacent to the molten metal. This object may be the electrically non-conductive fluid. The force, applied to the electrically non-conductive medium by the deformation of the mass of fluid metal, may generate a movement within the electrically non-conductive fluid which may result in ejection of a droplet of the electrically non-conductive fluid through the orifice.

The electrically non-conductive fluid may be molten glass. It is necessary to keep the glass at a temperature at least equal to the melting temperature of the glass, which dependent on the composition of the glass lies in the range of between 800° C. and 1750° C. (the latter being the melting temperature of fused silica).

The electrically non-conductive fluid and the molten metal should be substantially non-mixed during jetting.

In a particular embodiment, the molten metal and the electrically non-conductive fluid are separated by a suitable membrane. A suitable membrane should be at least heat resistant, deformable at high temperatures and resistant to both the electrically conductive medium and the electrically non-conductive fluid, also at the elevated temperatures at which the device is operated. An example of a suitable membrane may be a thin layer of silicon. Alternatively, the membrane may be a fluid membrane, the fluid membrane consisting of a fluid that does not mix with the molten metal and does not mix with the electrically non-conductive fluid, either. A fluid membrane, because of its fluid character, is easily deformable by the force applied by the molten metal and consequently, the electrically non-conductive fluid may be actuated.

In an embodiment, the method according to the present invention comprises the additional step of actively cooling the fluid, preferably by contacting the fluid chamber with a cooled collar 110 as shown in FIG. 1. Such a cooled collar may be made of aluminum nitride (A1N), for example the commercially known Shapal$^{TM}$. The collar may be provided with channels for accommodating a flow of a cooling fluid, for example water. The method according to this embodiment provides additional cooling, when necessary.

The present invention also relates to a jetting device suitable for performing the above described method for controlling a temperature of the jetting device. Such a jetting device comprises:

- a fluid chamber body having a fluid chamber for containing an electrically conductive material to be jetted at a high temperature, the fluid chamber body being made of a material that is heat conductive and heat resistant, such as graphite, the fluid chamber body comprising an orifice extending from the fluid chamber to an outer surface of the fluid chamber body;
- a primary heating means, for providing heat to the electrically conductive material to melt, forming an electrically conductive fluid and heating the electrically conductive fluid to an operating temperature;
- an actuation means for actuating the electrically conductive fluid, the actuation means comprising at least an electrode for providing an electric current through the electrically conductive fluid and a magnet, for providing a magnetic field in the electrically conductive fluid;
- a controller arranged for performing a feed-forward method for controlling a temperature of the jetting device according to the present invention.

The primary heating means preferably comprises an inductive heating generator.

The jetting device may further comprise:

- a temperature sensing means arranged for collecting data concerning the actual temperature of the jetting device, the temperature sensing means preferably being a pyrometer;
- an electrically conductive shielding means arranged for shielding the inductive heating generator and thereby cooling to the electrically conductive fluid contained in the jetting device;
- a cooled collar arranged for being brought into contact with the jetting device and therefore provide active cooling of the jetting device;
- a flexible and heat resistant membrane for separating an electrically non-conductive fluid to be jetted from an electrically conductive medium. Upon actuation of the electrically conductive fluid, the generated force in the electrically conductive medium is transferred to the electrical conductive fluid by movement of the membrane. The transferred force in the electrically non-conductive fluid provides jetting of droplets of the electrically non-conductive fluid.

The controller may comprise:

- a user interface being arranged to get input data from the user, such as the desired operating conditions, e.g. temperature. The operating conditions may be dependent on the material to be jetted. The input data may also comprise a desired pattern to be printed on a receiving substrate, from which the time dependent load may be derived. The input data may be entered by hand or uploaded as a data file;
- a memory means for storing the input data and a relation between the jetting conditions, the settings of the primary heating means and the temperature of the jetting device. The relation may be an algorithm based on theoretical calculations and/or measured data. The relation may also be represented by a database containing combinations of jetting conditions, settings of the primary heating means and temperature of the jetting device. The second memory means may have a permanent character, such that the relation can be used for more than one print job. The actual temperature in combination with the accompanying jetting conditions and the settings of the primary heating means may be stored in the second memory means.

a computation means, arranged for determining a control action based on upcoming jetting conditions, derived from the time dependent load, the actual temperature and the desired operating conditions. The control action may comprise a change in the settings of the primary heating means and/or an change in the settings of the actuation means in order to change the jetting conditions, in particular the jetting frequency;

a driving means arranged for generating and sending a driver signal to the primary heating means and/or the actuation means, based on the determined control action.

In an embodiment, the memory means of the controller comprises:

a first memory means for storing the input data. The first memory means may have a transient character such that the input data may be stored temporarily (i.e. during a single print job).

a second memory means for storing a relation between the jetting conditions, the settings of the primary heating means and the temperature of the jetting device. The second memory means may have a more or less permanent character.

BRIEF DESCRIPTION OF THE DRAWINGS

These and further features and advantages of the present invention are explained hereinafter with reference to the accompanying drawings showing non-limiting embodiments and wherein.

DETAILED DESCRIPTION OF THE DRAWINGS

Figure 1:
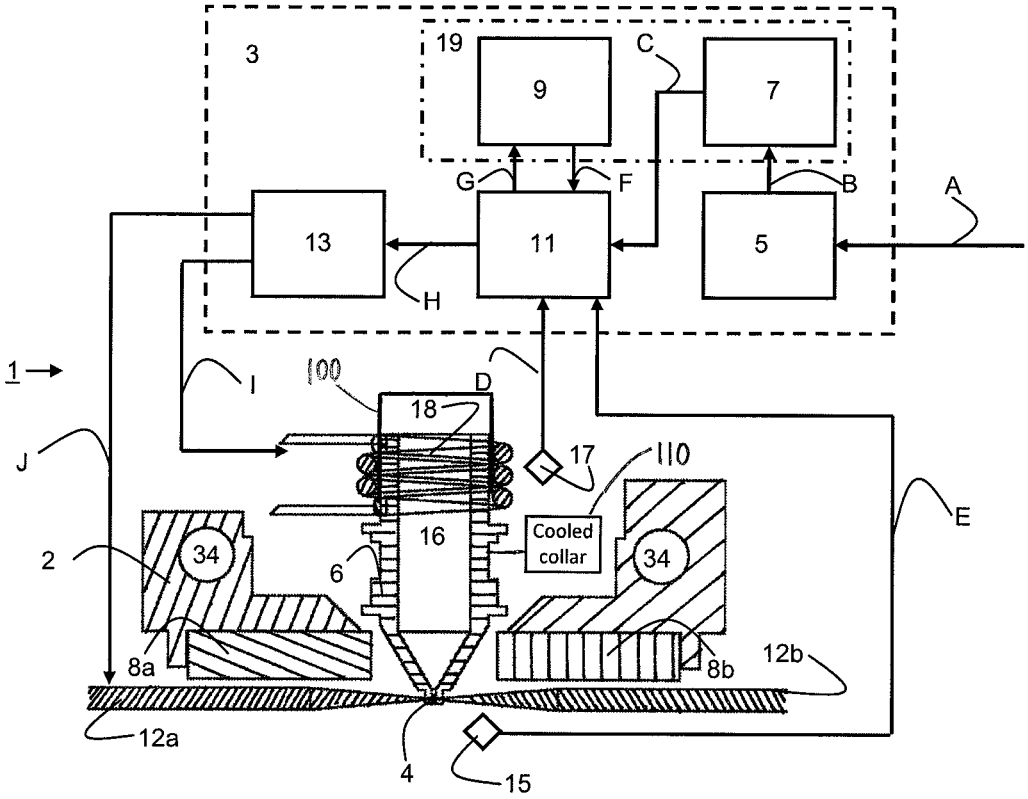
FIG. 1 shows a schematic representation of a jetting device according to the present invention.

FIG. 1 shows a part of a jetting device 1 for ejecting droplets of a relatively hot fluid, in particular a molten metal such as copper, silver, gold, nickel and the like. The jetting device 1 comprises a support frame 2, made of a heat resistant and preferably heat conductive material. As described hereinafter, the support frame 2 is cooled by a cooling liquid. Good heat conductivity increases the heat distribution through the support frame 2 and thereby increases a spreading of the heat. Further, the support frame 2 is preferably configured to absorb only a relatively small amount of heat from any of the heated parts of the jetting device 1. For example, the support frame 2 may be made of aluminum and be polished such that the aluminum reflects a relatively large amount, e.g. 95% or even more, of the heat radiation coming from any hot parts of the jetting device 1.

The jetting device 1 is provided with an ejection nozzle 4 through which a droplet of the fluid may be ejected. The nozzle or orifice 4 is a through hole extending through a wall of a fluid chamber body 6. In the fluid chamber body 6 a fluid chamber 16 is arranged. The fluid chamber 16 is configured to hold the fluid. Consequently, the fluid chamber body 6 needs to be heat resistant. Further, the fluid chamber body 6 is made such that the fluid, such as a molten metal, is enabled to flow over a surface, in particular an inner surface of the fluid chamber body 6, the inner surface forming a wall of the fluid chamber. Also, an inner wall of the through-hole forming the orifice 4 needs to be wetting for the fluid in order to enable the fluid to flow through the orifice 4. It is noted that this even more relevant compared to known fluid jet devices such as inkjet devices, since molten metals generally have a relatively high surface tension due to which molten metals tend to form beads. Such beads will generally not flow through a small hole such as the orifice 4. If the surface of the fluid chamber body 6 is wetting with respect to the fluid, the fluid will not tend to form beads, but will easily spread and flow over the surface and is thus enabled to flow into and through the orifice 4.

Further, it is noted that the fluid chamber body 6 is preferably made cost-effectively. For example, as molten metals tend to chemically react with oxygen, after molten metals have been ejected from the fluid chamber body 6, the fluid chamber body 6 may not be reusable when left in air, because metal remaining in the fluid chamber will most probably react with oxygen. Oxidation may take place mainly where oxygen is present so mainly at the metal-air interface in the reservoir and at the metal-air interface in or in the vicinity of the nozzle. After remelting, the thin layer of oxidized metal most probably forms particles which will mix with the molten metal. Oxidized metal particles tend to block the orifice 4 and/or change the wettability characteristics of the fluid chamber wall, thereby rendering the jetting device 1 unusable for further ejecting.

For ejecting droplets of molten metal, the jetting device 1 is provided with two permanent magnets 8*a*, 8*b* (hereinafter also referred to as magnets 8). The magnets 8 are arranged between two magnetic field concentrating elements (not shown) made of magnetic field guiding material such as iron. The jetting device 1 is further provided with two electrodes 12*a*, 12*b* (hereinafter also referred to as electrodes 12) both extending into the fluid chamber body 6 through a suitable through hole such that at least a tip of each of the electrodes 12 is in direct electrical contact with the molten metal present in the fluid chamber. The electrodes 12 are each operatively connected to a suitable electrical current generator (not shown) such that a suitable electrical current may be generated through the electrodes 12 and the molten metal present between the tips of the electrodes 12.

The magnets 8 and the concentrators are configured and arranged such that a relatively high magnetic field is obtained at and near the position of the orifice 4, in particular in the molten metal at the location between the two respective tips of the two electrodes 12*a*, 12*b*. As indicated in the introductory part hereof, the combination of an electrical current and the magnetic field results in a force exerted on the molten metal, which may result in a droplet of molten metal being pushed through the orifice 4, thereby ejecting a droplet.

The permanent magnets 8 are thermally isolated from the fluid chamber body 6 at least to the extent that the temperature of the magnets 8 does not exceed a predetermined threshold temperature. This threshold temperature is predetermined based on the temperature above which the magnets 8 may partially or totally loose their magnetization. For example, using a certain type of permanent magnets 8 made of NdFeB, such a threshold temperature may be up to 180° C. In order to achieve such a low temperature, in an embodiment, the magnets 8 may also be actively cooled e.g. using suitable cooling means, such as a cooling liquid.

The electrodes 12 are made of a suitable material for carrying a relatively high current, while being resistant against high temperatures. The electrodes 12 may be suitably made of tungsten (W), although other suitable materials are contemplated.

The interior wall of the fluid chamber body 6 defining the fluid chamber 16 is in accordance with the present invention wetting with respect to the fluid to be ejected through the orifice 4. For example, the fluid chamber body 6 is made of graphite and the fluid to be ejected is molten titanium (Ti). In another embodiment, the fluid to be ejected is gold (Au), silver (Ag) or copper (Cu). These metals do not wet on graphite and therefore tend to form beads. Such beads cannot be ejected through the orifice 4 without application of an additional force such as a gas pressure. In accordance with the present invention, the interior wall forming the fluid chamber 16 is therefore suitably coated. In a particular embodiment, the coating comprises tungsten-carbide (WC, $W_2C$, $W_3C$). The coating may be provided by chemical vapor deposition (CVD), for example. A coating comprising tungsten-carbide is wetting for a large number of molten metals and is therefore very suitable. Other suitable embodiments of coatings include chrome-carbide ($Cr_xC_y$). Chrome-carbide is wetting for copper (Cu) and has a relatively low melting temperature. So, although a suitable embodiment of a coating in accordance with the present invention, it is only suitable for use with a limited number of metals.

In an embodiment, at an outer surface, in particular around the orifice 4, the surface is non-wetting for the fluid to be ejected in order to prevent ejection disturbances due to fluid present around the orifice 4. If the above-mentioned wetting coating is also provided at the outer surface, it may be preferable to remove the wetting coating around the orifice 4.

In the illustrated embodiment, the support frame 2 is provided with cooling channels 34 through which a cooling liquid may flow for actively cooling of the support frame 2 and the magnets 8. A primary heating means 18, in the present example an induction coil is shown. The fluid chamber body 6 is arranged in a center of the induction coil such that a current flowing through the induction coil results in heating of a metal arranged in the fluid chamber 16. Due to such heating the metal may melt and thus become a fluid. Such inductive heating ensures a power-efficient heating and no contact between any heating element and the fluid, limiting a number of (possible) interactions between elements of the jetting device 1 and the fluid.

In an embodiment the fluid chamber body 6 is made of a material that is heated by inductive heating. As mentioned above, this increases the heating efficiency and in particular decreases a time period needed for melting a metal present in the fluid chamber in a solid state.

The two electrodes 12*a*, 12*b* each have a conically shaped end. These conically shaped ends extend into the fluid chamber 16 through suitable electrode passages in order to provide a fluid tight closure. The ends of the electrodes 12 are arranged such that the ends are in direct electrical contact with the metal fluid in the fluid chamber.

FIG. 1 further shows a controller 3, comprising a user interface 5 for entering input data by an operator, as indicated by arrow A. Such input data may comprise jetting conditions such as a desired operating temperature. The input data also comprise printing conditions, such as a desired pattern to be printed on a receiving substrate. The pattern to be printed may be determined based on a certain printing strategy (or process). A parameter may be the number of printed dots per unit of substrate length, which may also be expressed in terms of dot pitch (i.e. distance between subsequently printed dots), as previously discussed. The input data are at least temporarily (i.e. during a print job) stored in a first memory means 7, as indicated by arrow B. In a more advanced embodiment, the operator may select which electrically conductive material is to be jetted and the corresponding operating conditions are retrieved from a second memory means 9 on which such conditions are stored. The second memory means 9, further contains a relation between jetting conditions (e.g. actuation frequency), settings of the primary heating means (e.g. heating current) and a temperature of the jetting device. Such a relation may be a predetermined theoretical or empirical relation between the above stated parameters and/or may be a database comprising measured data, e.g. measurements of the temperature of the jetting device at predetermined primary heater settings and actuation frequencies. Such a database may be used as a look-up table. The first and the second memory means are both part of memory means 19.

FIG. 1 further shows that the jetting device of this particular embodiment comprises a first temperature sensing means 15 and a second temperature sensing means 17. The first temperature sensing means 15 is arranged for measuring the actual temperature of the nozzle 4 ($T_1$). The second temperature sensing means 17 is arranged for measuring the actual temperature of the fluid chamber body 6, which temperature is a measure for the temperature of the bulk of the molten electrically conductive material contained in the fluid chamber 16 ($T_2$).

Both temperature sensing means (15 and 17) may be pyrometers. The second temperature sensing means 17, may also be a thermocouple arranged inside the fluid chamber 16.

The relation between the temperature of the bulk of the electrically conductive fluid and the fluid chamber body 6 can be empirically determined. The second temperature sensing means is however optional, because the nozzle temperature ($T_1$) is the critical temperature to be controlled according to the present invention. The temperature control mechanism may be solely based on the determination of settings of the primary heater based on upcoming jetting conditions and a measurement of the actual nozzle temperature ($T_1$), as determined by temperature sensing means 15.

Figure 2:
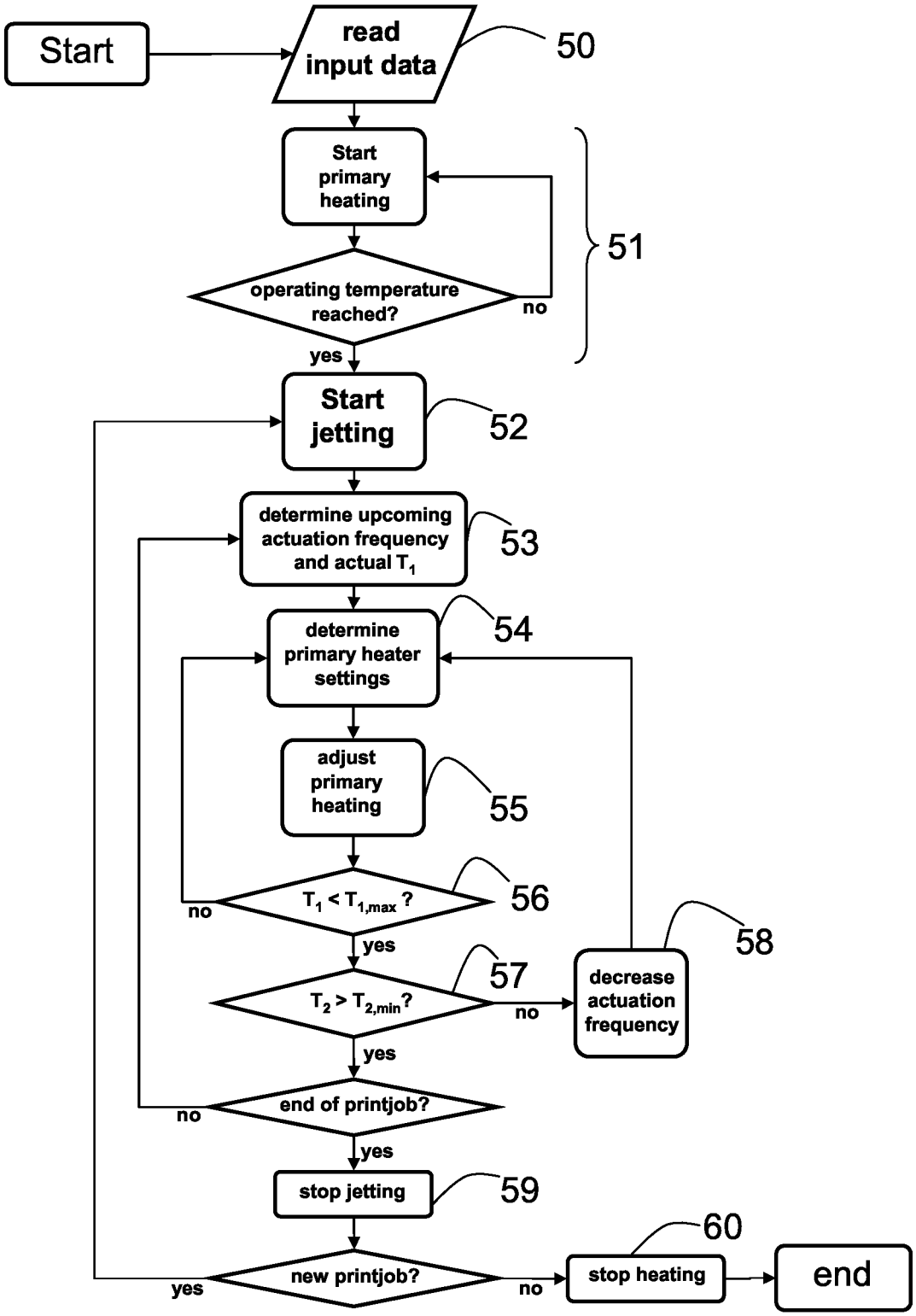
FIG. 2 shows a flow diagram of a method according to the present invention.

FIG. 1 shows that the controller 3 comprises a computation means 11. The computation means retrieves the input data from the first memory means and the actual temperatures $T_1$ and optionally $T_2$, as indicated by arrows C, D and E respectively. The computation means 11 determines the upcoming jetting conditions, which are deduced from the desired printing conditions (e.g. the pattern to be printed), which is stored on the first memory means 7. Based on the input data, the derived upcoming jetting conditions and the actual temperatures $T_1$ and $T_2$, a control action is determined by using the relation retrieved from the second memory means 9, as indicated by arrow F. The control action may comprise a change in the settings of the primary heating means and/or a change in the settings of the actuation means in order to change the jetting conditions, in particular the jetting frequency. The selection of the control action is explained in more detail when FIG. 2 is discussed.

The actual temperatures $T_1$ and/or $T_2$ in combination with the accompanying jetting conditions and the settings of the primary heating means may be stored in the second memory means, as indicated by arrow G. By adding data, the earlier described relation becomes more accurate and the controller will be able to provide a more accurate temperature control of the jetting device.

The computation means passes the determined control action to a driving means 13, as indicated by arrow H. In this particular embodiment, the driving means 13 is considered as a part of the controller. The driving means may however also be considered part of the jetting device, e.g. both the primary heating means and the actuations means may be connected to separate driving means, which driving means provide a heating current and an actuation current respectively, based on the control action as determined by the computation means 11.

In the present embodiment, the driving means generates and sends a driving signal to the primary heating means and/or the actuation means, based on the control action as determined by the computation means 11, as indicated by arrows I and J, respectively.

FIG. 2. shows a flow diagram of a method for controlling the temperature of the nozzle 4 of the jetting device 1 as performed by the controller 3.

In a first step 50, the computation means 11 retrieves the input data comprising the desired operating temperature and the previously discussed printing parameters (e.g. pattern and/or number of dots per unit length of substrate and/or dot-pitch) from the first memory means 7. Based on the acquired input data, the jetting conditions may be determined and the corresponding settings for the primary heating means may be looked-up or calculated (not shown as separate steps in FIG. 2).

In a second step 51 the controller 3 starts heating the jetting device 1 to the desired operating temperature. The desired operating temperature may be monitored by temperature sensing means 15 (i.e. the nozzle temperature ($T_1$) is monitored) or by temperature sensing means 17 (i.e. the bulk temperature ($T_2$) is monitored. The driving means 13 generates and sends a driving signal to the induction coil of the primary heating means 18 as determined by computation means 11. When the operating temperature has been reached, the electrically conductive material contained in the fluid chamber 6 has melted and the jetting process is started in a third step 52. Immediately after starting the jetting process, the primary heating may be adjusted in accordance with the initial jetting conditions (not shown as a separate step in FIG. 2).

In the determination (i.e. looking-up or calculating) of the settings for the primary heating means (first step), the retrieved input data from which the jetting conditions have been determined may have been taken into account as discussed above. Hence, the additional heat induced when the jetting process has started has been compensated for in advance. Alternatively, the jetting process may be started on a dummy substrate using the jetting conditions determined based on the input data as retrieved in the first step. When the operating temperature has become within a desired temperature range (a range around the desired operating temperature), with the aid of a temperature controlling method according to the present invention, the dummy substrate may be exchanged with an actual substrate and the actual printing process may commence.

In a fourth step 53 the computing means 11 determines up-coming jetting conditions, for example the actuation frequency. The up-coming actuation frequency may be derived from the desired pattern to be printed on a receiving substrate which is retrieved from the first memory means 7. In a particular embodiment, the actuation frequency and the dot-pitch are kept constant during the printing process. In this embodiment the up-coming jetting conditions are more or less constant.

In a fifth step 54, the computation means determines settings for the primary heating means based on the upcoming actuation frequency (which may be constant as described above) by using the relation between temperature and the settings of the primary heating means and het actuation means as retrieved from the second memory means 9. The actual $T_1$ is used to fine-tune the retrieved settings of the primary heating means.

In a sixth step 55, these settings are passed by the computation means 11 to the driving means 13 which generates a driving signal for the induction coil of the primary heating means 18, such that the temperature of the nozzle 4, $T_1$ is maintained within a certain desired range, i.e. $T_{1,min} \leq T_1 \leq T_{1,max}$. When $T_1$ tends to become close to or exceeds $T_{1,max}$, the computation means 11 determines new settings for the primary heating means and the primary heating is adjusted accordingly (see 56 in FIG. 2). $T_{1,min}$ is above the melting point of the fluid to be jetted in order to prevent solidification of the fluid in the jetting device. If $T_1$ approaches $T_{1,min}$, the computation means 11 determines new settings for the primary heating means and the primary heating is adjusted accordingly. In parallel, the computation means 11 stores the actual temperatures ($T_1$ and/or $T_2$) together with the accompanying setting of the primary heater and the actuation means on the second memory means 9.

In a seventh step 57, which is optional and may be dependent on a specific application, the computation means determines if the temperature of the bulk of the electrically conductive fluid, $T_2$, represented by the temperature measured by temperature sensing means 17 does not become too low, i.e. below $T_{2,min}$. At high loads, i.e. high actuation frequencies and small dot-pitch, the contribution of the Joule effect caused by Lorentz actuations may become very large, such that $T_2$ may become too low due to the effort of the controller to main the temperature of the nozzle within the desired range, $T_{1,min} \leq T_1 \leq T_{1,max}$. In such cases the computation means 11 may maintain a minimum driving current to the induction coil of the primary heating means 18 in order to make sure that $T_2$ does not drop below $T_{2,min}$ required to maintain a proper and safe jetting process.

In order to prevent overheating of the jetting device 1, in particular of the nozzle 4, the actuation frequency is decreased in an eighth step 58 and new settings of the primary heater are determined during the jetting process (see 54).

When the print job is finished, the jetting process is stopped, as indicated with 59. The entire process as described above may be repeated for a further (new) print job. Finally, if no further print job has to be performed, the (primary) heating and hence the printing process may be stopped, as indicated with 60.

The above described embodiment comprises a master-slave temperature control arrangement, wherein the slave control loop is a feed-forward loop based on the advance knowledge of the time dependent load. The master control loop comprises a feed-back loop based on the actual bulk temperature of the electrically conductive fluid $T_2$ and prevents that the temperature of the bulk of the electrically conductive fluid becomes too low.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually and appropriately detailed structure. In particular, features presented and described in separate dependent claims may be applied in combination and any combination of such claims are herewith disclosed. Further, the terms and phrases used herein are not intended to be limiting; but rather, to provide an understandable description of the invention. The terms "a" or "an", as used herein, are defined as one or more than one. The term another, as used herein, is defined as at least a second or more. The terms including and/or having, as used herein, are defined as comprising (i.e., open language). The term coupled, as used herein, is defined as connected, although not necessarily directly.

The invention claimed is:

1. A method for controlling a temperature of a jetting device, the jetting device being configured to jet droplets of a fluid at a high temperature, the fluid comprising an electrically conductive fluid, wherein at least a part of the fluid is positioned in a magnetic field, the method comprising the steps of:

a. heating the jetting device to an operating temperature, being defined as the temperature suitable for jetting droplets, using a primary heater;

b. jetting droplets by providing an electrical actuation current in the part of the fluid positioned in the magnetic field, thereby generating a force in the conductive fluid;

c. determining upcoming jetting conditions, the upcoming jetting conditions being defined as the jetting conditions corresponding to droplets to be jetted at a time ($t_1$) which is later than the present time ($t_0$) based on knowledge of a desired pattern to be printed on a receiving substrate;

d. determining settings for the primary heater, based on the determined upcoming jetting conditions and anticipation of a future Joule heating effect which will occur; and e. controlling the heating of the jetting device using the primary heater in accordance with the determined settings.

2. The method according to claim 1, wherein steps c, d and e are repeatedly performed during operations of the jetting device.

3. The method according to claim 1, comprising the additional steps of:

f. measuring the actual temperature of the jetting device during operation of the jetting device;

g. determining settings for the primary heater, based on the actual temperature of the jetting device;

h. heating the jetting device using the primary heater, based on the determined settings for the primary heater.

4. The method according to claim 1, wherein a first temperature of the jetting device ($T_1$) is controlled by controlling a second temperature of the jetting device ($T_2$), the first temperature being a temperature of the fluid in a region where actuation currents are passed through the electrically conductive fluid, the second temperature being a bulk temperature of the electrically conductive fluid.

5. The method according to claim 4, wherein the method comprises the following additional steps:

determining the second temperature ($T_2$); and reducing an actuation frequency if $T_2<T_{2,min}$, wherein the actuation frequency is defined as a number of droplets to be jetted as a function of time, and the $T_{2,min}$ is defined as a minimum temperature of the bulk temperature of the electrically conductive fluid.

6. The method according to claim 1, wherein the difference between $t_1$ and $t_0$ is equal to a thermal response time ($\Delta t_R$) of the jetting device and/or the electrically conductive fluid contained inside the jetting device.

7. The method according to claim 1, wherein the primary heater is an inductive heating generator and the settings for the primary heater comprise a heating current.

8. The method according to claim 7, wherein the heating is adjusted by at least partly shielding the inductive heating generator by using an electrically conductive shield.

9. The method according to claim 1, wherein the electrically conductive fluid comprises a molten metal or a molten semi-conductor.

10. The method according claim 1, wherein the electrically conductive fluid comprises an electrically non-conductive fluid and an electrically conductive medium.

11. The method according to claim 10, wherein the electrically conductive medium is a molten metal.

12. The method according to claim 10, wherein the electrically non-conductive fluid is molten glass.

13. The method according to claim 1, wherein the method comprises the additional step of actively cooling the fluid.

14. A jetting device comprising:

a fluid chamber body having a fluid chamber for containing an electrically conductive material to be jetted at a high temperature, the fluid chamber body being made of a material that is heat conductive and heat resistant the fluid chamber body comprising an orifice extending from the fluid chamber to an outer surface of the fluid chamber body;

a primary heater, for providing heat to the electrically conductive material to melt, forming an electrically conductive fluid and heating the electrically conductive fluid to an operating temperature;

an actuator for actuating the electrically conductive fluid, the actuator comprising at least an electrode for providing an electric current through the electrically conductive fluid and a magnet, for providing a magnetic field in the electrically conductive fluid; and a controller arranged for performing a feed-forward method for controlling a temperature of the jetting device, the controller being configured to:

control the primary heater to heat the jetting device to the operating temperature, being defined as the temperature suitable for jetting droplets;

control the jetting device to jet droplets by controlling the actuator to provide an electrical actuation current in the part of the fluid positioned in the magnetic field, thereby generating a force in the conductive fluid;

determine upcoming jetting conditions, the upcoming jetting conditions being defined as the jetting conditions corresponding to droplets to be jetted at a time ($t_1$) which is later than the present time ($t_0$) based on knowledge of a desired pattern to be printed on a receiving substrate;

determine settings for the primary heater, based on the determined upcoming jetting conditions and anticipation of a future Joule heating effect which will occur; and control the heating of the jetting device using the primary heater in accordance with the determined settings.

15. The jetting device according to claim 14, wherein the controller comprises:

a user interface being arranged to get input data from the user;

a memory for storing the input data and a relation between the jetting conditions, the settings of the primary heater and the temperature of the jetting device;

a computation device, arranged for determining a control action based on upcoming jetting conditions, derived from the time dependent load, the actual temperature and the desired operating conditions; and a driving device arranged for generating and sending a driver signal to the primary heater and/or the actuator based on the determined control action.

16. The method according to claim 2, comprising the additional steps of:

i. measuring the actual temperature of the jetting device during operation of the jetting device;

j. determining settings for the primary heater, based on the actual temperature of the jetting device; and k. heating the jetting device using the primary heater, based on the determined settings for the primary heater.

17. The method according to claim 2, wherein a first temperature of the jetting device ($T_1$) is controlled by controlling a second temperature of the jetting device ($T_2$), the first temperature being a temperature of the fluid in a region where actuation currents are passed through the electrically conductive fluid, the second temperature being a bulk temperature of the electrically conductive fluid.

18. The method according to claim 3, wherein a first temperature of the jetting device ($T_1$) is controlled by controlling a second temperature of the jetting device ($T_2$), the first temperature being a temperature of the fluid in a region where actuation currents are passed through the electrically conductive fluid, the second temperature being a bulk temperature of the electrically conductive fluid.

19. The method according to claim 2, wherein the difference between $t_1$ and $t_0$ is equal to a thermal response time ($\Delta t_R$) of the jetting device and/or the electrically conductive fluid contained inside the jetting device.

20. The method according to claim 3, wherein the difference between $t_1$ and to is equal to a thermal response time ($\Delta t_R$) of the jetting device and/or the electrically conductive fluid contained inside the jetting device.

21. The method according to claim 11, wherein the electrically conductive medium has a melting point below the melting point of the electrically non-conductive fluid and below the jetting temperature.

22. The method according to claim 13, wherein the additional step of actively cooling the fluid is performed by contacting the fluid chamber with a cooled collar.

23. The method according to claim 13, wherein the cooled collar is made of A1N.

* * * * *